US007891208B2

(12) United States Patent
Kim et al.

(10) Patent No.: US 7,891,208 B2
(45) Date of Patent: Feb. 22, 2011

(54) REFRIGERATOR AND CONTROL METHOD THEREOF

(75) Inventors: Ji Hoon Kim, Jeju-si (KR); Jae Koog An, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 286 days.

(21) Appl. No.: 11/948,985

(22) Filed: Nov. 30, 2007

(65) Prior Publication Data

US 2008/0141687 A1 Jun. 19, 2008

(30) Foreign Application Priority Data

Dec. 7, 2006 (KR) ..... 10-2006-0123930
May 23, 2007 (KR) ..... 10-2007-0050133

(51) Int. Cl.
*F25C 1/14* (2006.01)
*F25C 1/00* (2006.01)

(52) U.S. Cl. ..... 62/354; 62/137; 62/66; 62/135

(58) Field of Classification Search ..... 62/135, 62/137, 344, 66, 340
See application file for complete search history.

(56) References Cited

U.S. PATENT DOCUMENTS 6,050,097 A * 4/2000 Nelson et al. ..... 62/137

FOREIGN PATENT DOCUMENTS

KR 10-0565621 3/2006

* cited by examiner

*Primary Examiner*—Cheryl J Tyler
*Assistant Examiner*—Cassey Bauer
(74) *Attorney, Agent, or Firm*—Staas & Halsey LLP

(57) ABSTRACT

A refrigerator including an ice making device to make ice and a control method of the refrigerator. The refrigerator includes the ice making device to make ice, and an ice reservoir disposed below the ice making device to receive the ice made by the ice making device. The ice making device includes an ice-full state sensing lever installed, in a vertically pivotally rotatable manner, at one side thereof to sense whether or not the ice reservoir is full of ice, and a lever cover to cover a side surface of the ice-full state sensing lever. With the use of the lever cover, even if the ice is caught between a wall surface of an ice making compartment and the ice making device, the ice is caught between the wall surface of the ice making compartment and the lever cover. This has the effect of assuring a stable operation of the ice-full state sensing lever.

1 Claim, 6 Drawing Sheets

REFRIGERATOR AND CONTROL METHOD THEREOF

CROSS-REFERENCE TO RELATED APPLICATIONS

This application claims the benefit of Korean Patent Applications No. 2006-123930, filed on Dec. 7, 2006 and 2007-50133, filed on May 23, 2007 in the Korean Intellectual Property Office, et al., the disclosure of which are incorporated herein by reference.

BACKGROUND OF THE INVENTION

1. Field of the Invention

The present invention relates to a refrigerator having an ice making device, and, more particularly, to a refrigerator having an ice making device to make ice.

2. Description of the Related Art

In general, a refrigerator includes several devices constituting a refrigeration cycle, and can keep food stored therein in a chilled or frozen state by use of cold air generated from the constituent devices of the refrigeration cycle. Among conventional refrigerators, a refrigerator disclosed in Korean Registered Patent No. 565621 is configured such that a refrigerating compartment, having a relatively high use frequency, is defined in an upper region of a refrigerator body and a freezing compartment, having a relatively low use frequency, is defined in a lower region of the body.

The conventional refrigerator includes a dispenser to allow a user to take out ice and water at the outside of the refrigerator without opening a refrigerating compartment door. Also, the refrigerator includes an ice making compartment defined separately in the refrigerating compartment. The ice making compartment incorporates an ice making device to make the ice to be discharged through the dispenser, and an ice transfer device disposed below the ice making device to receive and store the ice made by the ice making device and to transfer the ice to the dispenser when it is requested to discharge the ice through the dispenser.

The ice making device includes an ice making tray to make ice upon receiving water, an ejector to be rotated by a rotating force generated from an ice making motor so as to separate the ice made in the ice making tray from the ice making tray, and an ice-full state sensing lever having one end rotatably installed to a side of the ice making tray so as to determine whether or not an ice reservoir is filled with ice to a predetermined level and reaches an ice-full state. When the ice reservoir is full of ice, the operation of the ice making device can be stopped.

The ice transfer device includes the ice reservoir to store the ice fallen from the ice making device located above thereof, the ice reservoir having an outlet to discharge the ice to be discharged through the dispenser, and a spiral auger rotatably installed in the ice reservoir and adapted to be rotated by a rotating force generated from a transfer motor so as to transfer the ice toward the outlet.

In the above described conventional refrigerator, if the ice is separated from the ice making tray by the ejector, the ice falls down into the ice reservoir located below the ice making tray through a space between a side surface of the ice making tray and a wall surface of the ice making compartment. Therefore, there is a risk that the ice separated from the ice making tray is caught between the wall surface of the ice making compartment and the ice-full state sensing lever installed at the side of the ice making tray, thereby preventing a movement of the ice-full state sensing lever. This consequently causes a malfunction of the ice-full state sensing lever.

SUMMARY OF THE INVENTION

Accordingly, it is an aspect of the invention to provide a refrigerator capable of preventing a malfunction of an ice-full state sensing lever used to measure the amount of ice received in an ice reservoir, and a control method of the refrigerator.

Additional aspects and/or advantages of the invention will be set forth in part in the description which follows and, in part, will be obvious from the description, or may be learned by practice of the invention.

In accordance with an aspect of the invention, the above and/or other aspects can be achieved by the provision of a refrigerator comprising an ice making device to make ice, and an ice reservoir disposed below the ice making device to receive the ice made by the ice making device, wherein the ice making device comprises an ice-full state sensing lever installed, in a vertically pivotally rotatable manner, at one side thereof to sense whether or not the ice reservoir is full of ice, and a lever cover to cover a side surface of the ice-full state sensing lever.

The ice making device may further comprise an ice making tray to receive water therein, the ice-full state sensing lever being installed, in a vertically pivotally rotatable manner, at one side of the ice making tray, and the lever cover may be spaced apart from a side surface of the ice making tray by a predetermined distance, to install the ice-full state sensing lever between the lever cover and the side surface of the ice making tray.

The lever cover may comprise a cover portion extending vertically to cover the side surface of the ice-full state sensing lever and a fixing portion extending laterally from an upper end of the cover portion so as to be fixed to one side of an upper surface of the ice making tray.

The lever cover may comprise a cover portion extending vertically to cover the side surface of the ice-full state sensing lever and a guide portion extending obliquely from an upper end of the cover portion to the top of a side region of the ice making tray so as to guide the ice separated from the ice making tray, the guide portion being integrally formed with the cover portion.

In accordance with another aspect of the invention, there is provided a control method of a refrigerator comprising an ice making device to make ice, an ice reservoir to store the ice, an ice-full state sensing lever to sense whether or not the ice reservoir is full of ice, and a lever-position sensor to sense the position of the ice-full state sensing lever, the control method comprising: making ice by operation of the ice making device; determining whether or not the ice reservoir is full of ice by periodically moving and returning the ice-full state sensing lever until it is determined that the ice reservoir is full of ice; and stopping the operation of the ice making device if it is determined that the ice reservoir is full of ice.

The determination of whether or not the ice reservoir is full of ice by periodically moving and returning the ice-full state sensing lever until it is determined that the ice reservoir is full of ice may comprise: determining whether or not a preset time has passed; moving the ice-full state sensing lever after the preset time has passed; sensing the position of the ice-full state sensing lever by use of the lever-position sensor; determining whether or not the ice reservoir is full of ice on the basis of the position of the ice-full state sensing lever; returning the ice-full state sensing lever to an original position thereof if the ice reservoir is not full of ice; and wherein the determination of whether or not a preset time has passed, the moving of the ice-full state sensing lever, the sensing of the position of the ice-full state sensing lever, the determination of whether or not the ice reservoir is full of ice, and the returning of the ice-full state sensing lever are repeated sequentially.

After stopping the operation of the ice making device, the sensing of the position of the ice-full state sensing lever by the lever-position sensor and the determination of whether or not the ice reservoir is full of ice on the basis of the position of the ice-full state sensing lever may be repeatedly performed until it is determined that the ice reservoir is not full of ice.

BRIEF DESCRIPTION OF THE DRAWINGS

These and/or other aspects and advantages of the exemplary embodiments of the invention will become apparent and more readily appreciated from the following description of the embodiments, taken in conjunction with the accompanying drawings, of which.

DETAILED DESCRIPTION OF THE PREFERRED EMBODIMENTS

Figure 1:
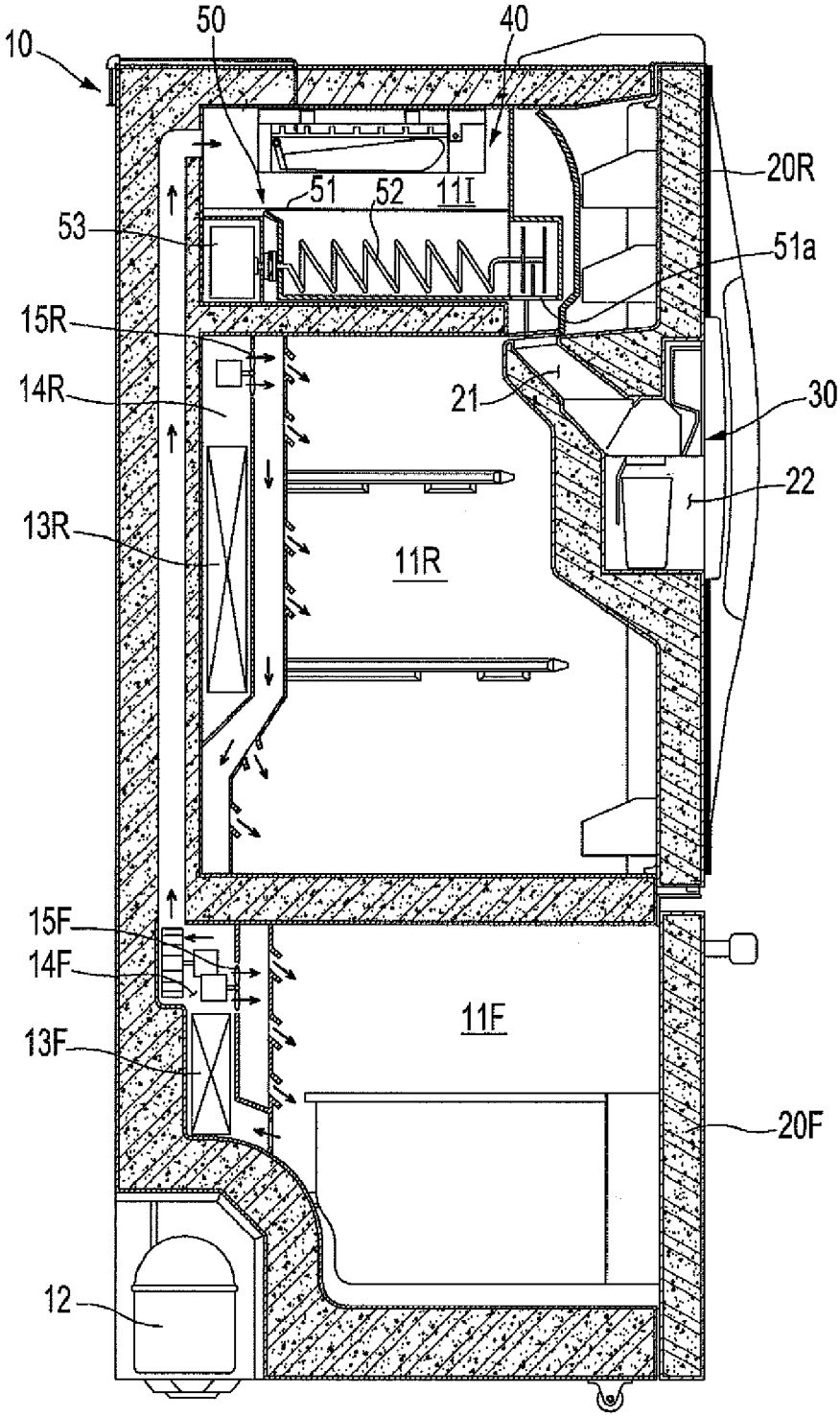
FIG. 1 is a sectional view showing the schematic configuration of a refrigerator according to the present invention.

Reference will now be made in detail to exemplary embodiments of the present invention, examples of which are illustrated in the accompanying drawings, wherein like reference numerals refer to like elements throughout. The embodiments are described below to explain the present invention by referring to the figures.

Referring to FIG. 1, a refrigerator according to the present invention includes a body 10 having storage compartments 11R and 11F to store food therein, and doors 20R and 20F hingedly coupled to one side of the body 10 so as to open or close the respective storage compartments 11R and 11F.

The storage compartments 11R and 11F are separated from each other by an intermediate partition. An upper one of the storage compartments serves as a refrigerating compartment 11R to store food in a chilled state, and the remaining lower storage compartment serves as a freezing compartment 11F to store food in a frozen state. The doors 20R and 20F include a refrigerating compartment door 20R to open or close the refrigerating compartment 11R, and a freezing compartment door 20F to open or close the freezing compartment 11F. With the use of the respective doors 20R and 20F, the freezing compartment 11F and the refrigerating compartment 11R can be opened or closed individually.

A compressor 12 to compress a refrigerant is installed in a rear bottom region of the body 10. Also, a refrigeration evaporator 13R and a freezing evaporator 13F are provided to generate cold air to be supplied into the refrigerating compartment 11R and the freezing compartment 11F. To receive these evaporators 13R and 13F, respectively, a refrigeration evaporator compartment 14R is partitioned off at the rear side of the refrigerating compartment 11R, and a freezing evaporator compartment 14F is partitioned off at the rear side of the freezing compartment 11F. The refrigeration evaporator compartment 14R and the freezing evaporator compartment 14F also receive a refrigeration circulating fan 15R and a freezing circulating fan 15F, respectively. These circulating fans 15R and 15F are adapted to generate a suction force and a blowing force by rotations thereof, to circulate the cold air, generated from the refrigeration evaporator 13R and the freezing evaporator 13F, into the refrigerating compartment 11R and the freezing compartment 11F.

The refrigerator according to the present invention further includes a dispenser 30 installed in the refrigerating compartment door 20R to allow a user to take out ice and water from the outside without opening the refrigerating compartment door 20R, an ice making device 40 to make ice to be discharged through the dispenser 30, and an ice transfer device 50 disposed below the ice making device 40 to receive and store the ice made by the ice making device 40 and to transfer the ice to the dispenser 30 when it is necessary to discharge the ice through the dispenser 30. An ice making compartment 11I is partitioned off at one side of the refrigerating compartment 11R, to receive the ice making device 40 and the ice transfer device 50. More specifically, the ice making device 40 is disposed in an upper region of the ice making compartment 11I, and the ice transfer device 50 is disposed in a lower region of the ice making compartment 11I.

The refrigerating compartment door 20R incorporates a discharge guide tube 21 therein. The discharge guide tube 21 communicates with the ice making compartment 11I when the refrigerating compartment 11R is closed by the refrigerating compartment door 20R. The discharge guide tube 21 guides the discharge of ice, to allow the user to take out the ice made by the ice making device 40 without opening the refrigerating compartment door 20R. The refrigerating compartment door 20R also has an ice discharge region 22 dented in a front surface thereof, to allow the user to easily receive the ice discharged through the discharge guide tube 21.

Figure 2:
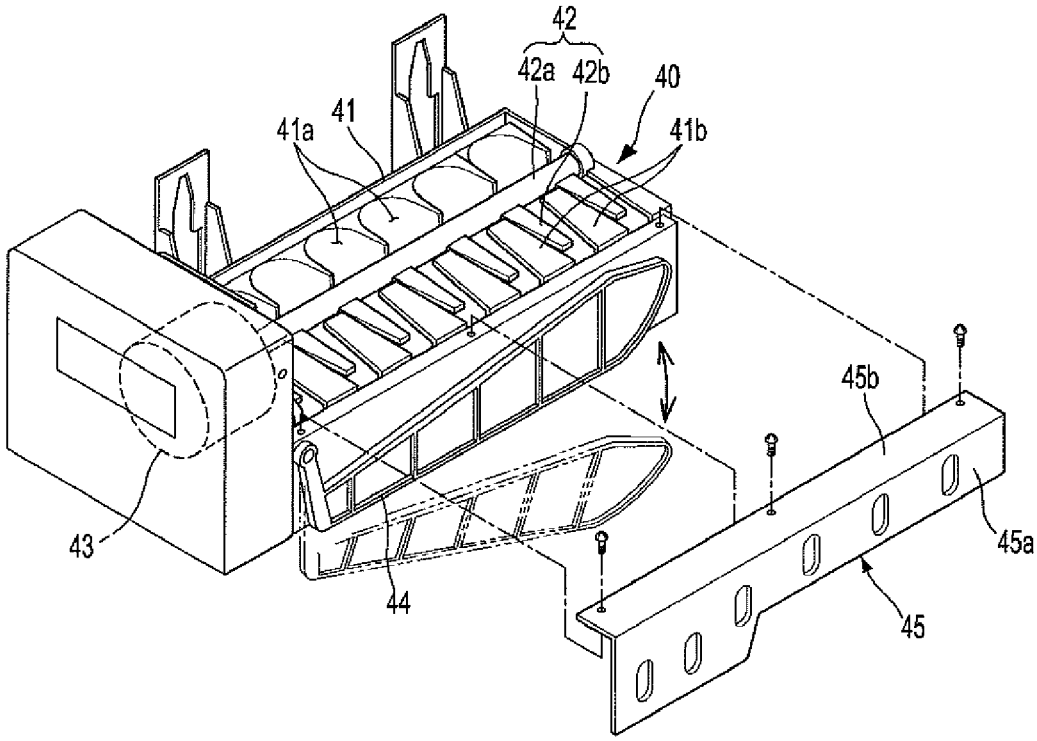
FIG. 2 is a perspective view of an ice making device for a refrigerator according to one exemplary embodiment of the present invention.

The ice making device 40, as shown in FIG. 2, includes an ice making tray 41 to make ice therein upon receiving water, an ejector 42 rotatably installed to separate the ice made in the ice making tray 41 from the tray 41, and an ice making motor 43 installed to a longitudinal end of the ejector 42 to rotate the ejector 42.

The ice making tray 41 has an ice making recess 41*a* defined therein. The ice making recess 41*a* has an approximately semi-cylindrical shape and is open upward. The ice making tray 41 also has a plurality of guide bars 41*b* arranged along one side of the tray 41. The guide bars 41*b* cover the top of a side region of the ice making recess 41*a*, to guide the ice, separated by the ejector 42, to the ice transfer device 50 located below thereof. Although not shown in the drawings, the ice making tray 41 incorporates a heater (not shown) in a lower region thereof to apply heat to the ice making tray 41 in order to facilitate the separation of the ice.

The ejector 42 includes a rotating shaft 42*a* disposed lengthwise in a longitudinal direction thereof, the rotating shaft 42*a* having one end connected to the ice making motor 43 so as to be rotated by the ice making motor 43, and a plurality of ejector pins 42*b* extending in a radial outward direction from the rotating shaft 42*a*, the ejector pins 42*b* being rotated to move the ice, made in the ice making tray 41, along an inner surface of the semi-cylindrical ice making recess 41*a*, so as to separate the ice from the tray 41.

The ice transfer device 50, as shown in FIG. 1, includes an ice reservoir 51 to receive and store the ice fallen from the ice making device 40 located above thereof, the ice reservoir 51 having a discharge hole 51*a* to discharge the ice to be discharged through the dispenser 30, a spiral auger 52 rotatably installed in the ice reservoir 51 to transfer the ice toward the discharge hole 51*a* by rotation thereof, and a transfer motor 53 to generate a rotating force required to rotate the auger 52.

The ice making device 40 employed in the refrigerator according to the present invention, as shown in FIG. 2, further includes an ice-full state sensing lever 44 to determine whether or not the ice reservoir 51 is full of ice by a predetermined level. The ice-full state sensing lever 44 is installed at one side of the ice making tray 41 in a vertically pivotally rotatable manner. As the ice-full state sensing lever 44 is pivotally rotated vertically, it can measure the height of the ice received in the ice reservoir 51, thereby sensing the amount of the ice. The on/off operation of the ice making device 40 is carried out on the basis of the height of the ice measured by the ice-full state sensing lever 44.

The ice making device 40 of the present invention further includes a lever cover 45 to cover a side surface of the ice-full state sensing lever 44, so as to prevent the operation of the ice-full state sensing lever 44 from being interfered with the ice. The lever cover 45 has a plate shape, and is spaced apart from a side surface of the ice making tray 41 by a predetermined distance. The ice-full state sensing lever 44 can be pivotally rotated vertically via a space between the side surface of the ice making tray 41 and the lever cover 45. In the present embodiment, the lever cover 45 includes a cover portion 45*a* extending vertically to cover the side surface of the ice-full state sensing lever 44, and a fixing portion 45*b* extending laterally from an upper end of the cover portion 45*a* so as to be fixed to one side of an upper surface of the ice making tray 41.

Figure 3:
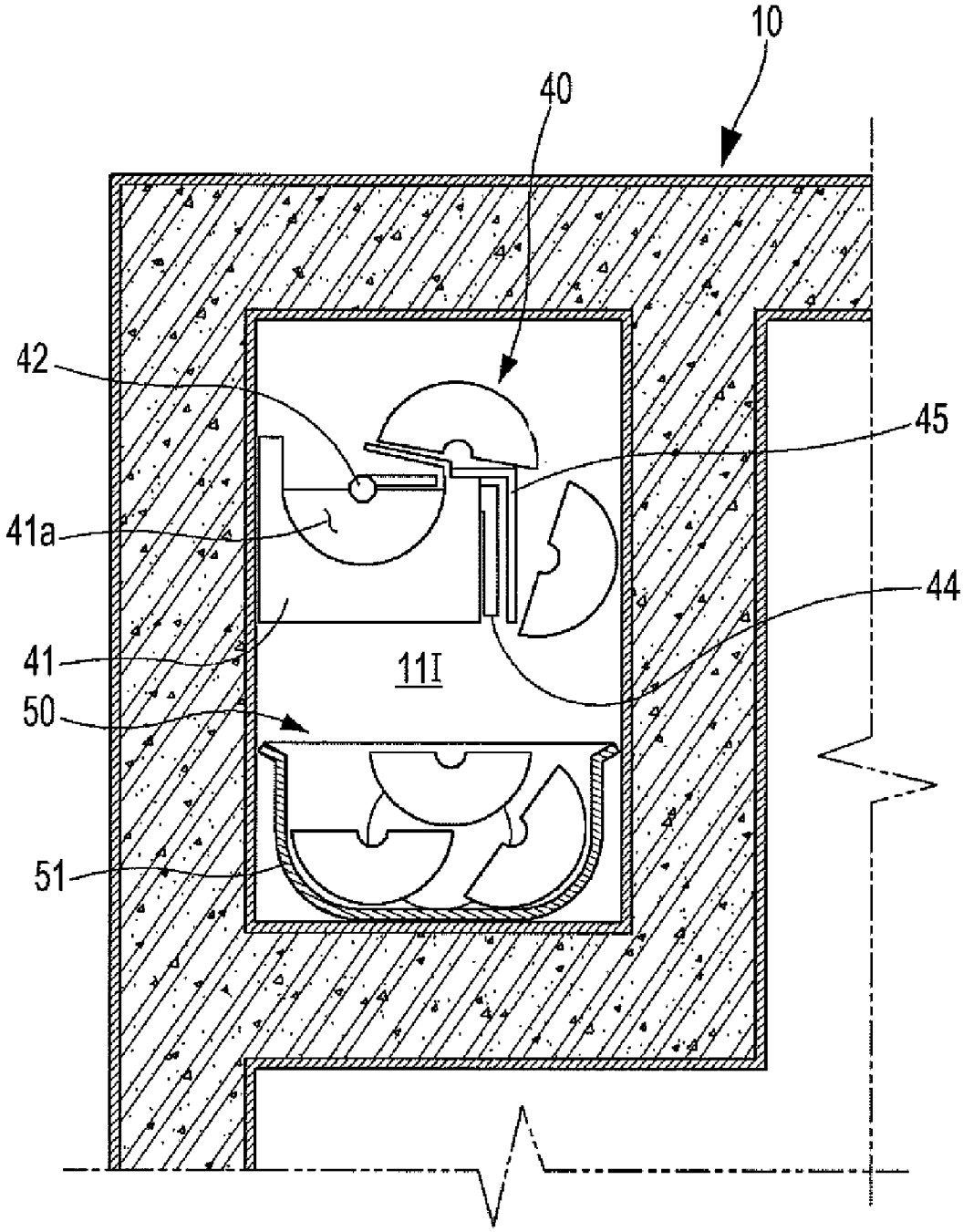
FIG. 3 is a schematic view showing the operation of the ice making device shown in FIG. 2.

With the above described configuration, even if the ice is caught between a wall surface of the ice making compartment 11I and the ice making device 40, the ice is caught between the wall surface of the ice making compartment 11I and the lever cover 45 as shown in FIG. 3. Therefore, the ice has no effect on the operation of the ice-full state sensing lever 44.

Figure 4:
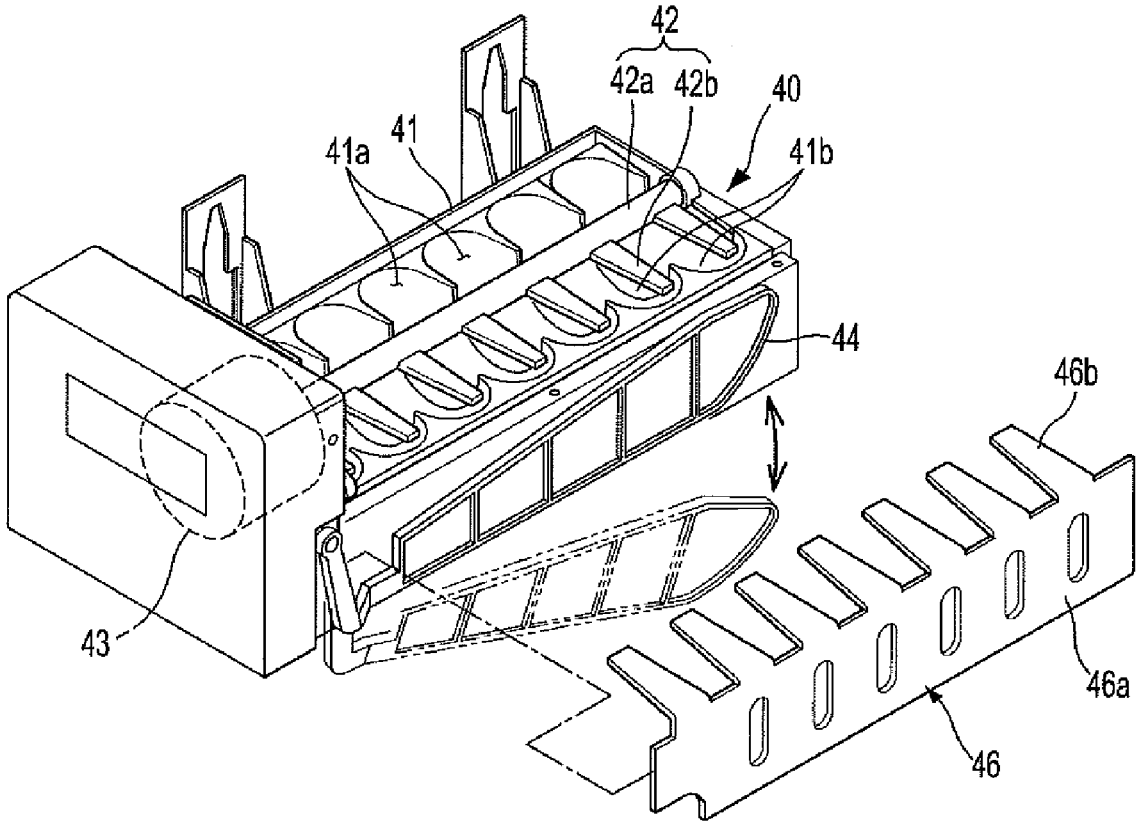
FIG. 4 is a perspective view showing an ice making device for a refrigerator according to another exemplary embodiment of the present invention.

Although the present embodiment illustrates the guide bars 41*b* integrally extending from one side of the ice making tray 41 to guide the ice separated from the ice making tray 41, the present invention is not limited thereto. For example, as shown in FIG. 4 illustrating another embodiment of the present invention, a lever cover 46 may include a cover portion 46*a* extending vertically to cover the side surface of the ice-full state sensing lever 44, and a guide portion 46*b* extending obliquely from an upper end of the cover portion 46*a* so as to cover the top of the side region of the ice making tray 41, the guide portion 46*b* being integrally formed with the cover portion 46*a*. The ice separated from the ice making tray 41 can be guided into the ice transfer device 50 located below thereof by the guide portion 46*b* provided at the lever cover 46.

Figure 5:
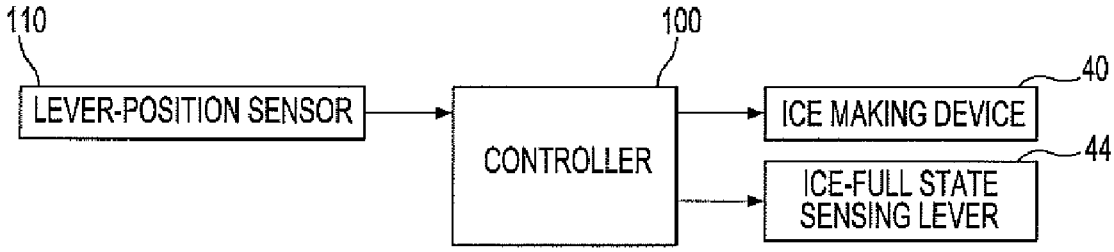
FIG. 5 is a control block diagram of the refrigerator according to the present invention.

Referring to FIG. 5, the refrigerator includes a controller 100 to control the overall operation of the refrigerator, and a lever-position sensor 110 provided at the input side of the controller 100 to sense the position of the ice-full state sensing lever 44. The above mentioned ice making device 40 and the ice-full state sensing lever 44 are provided at the output side of the controller 100.

Figure 6:
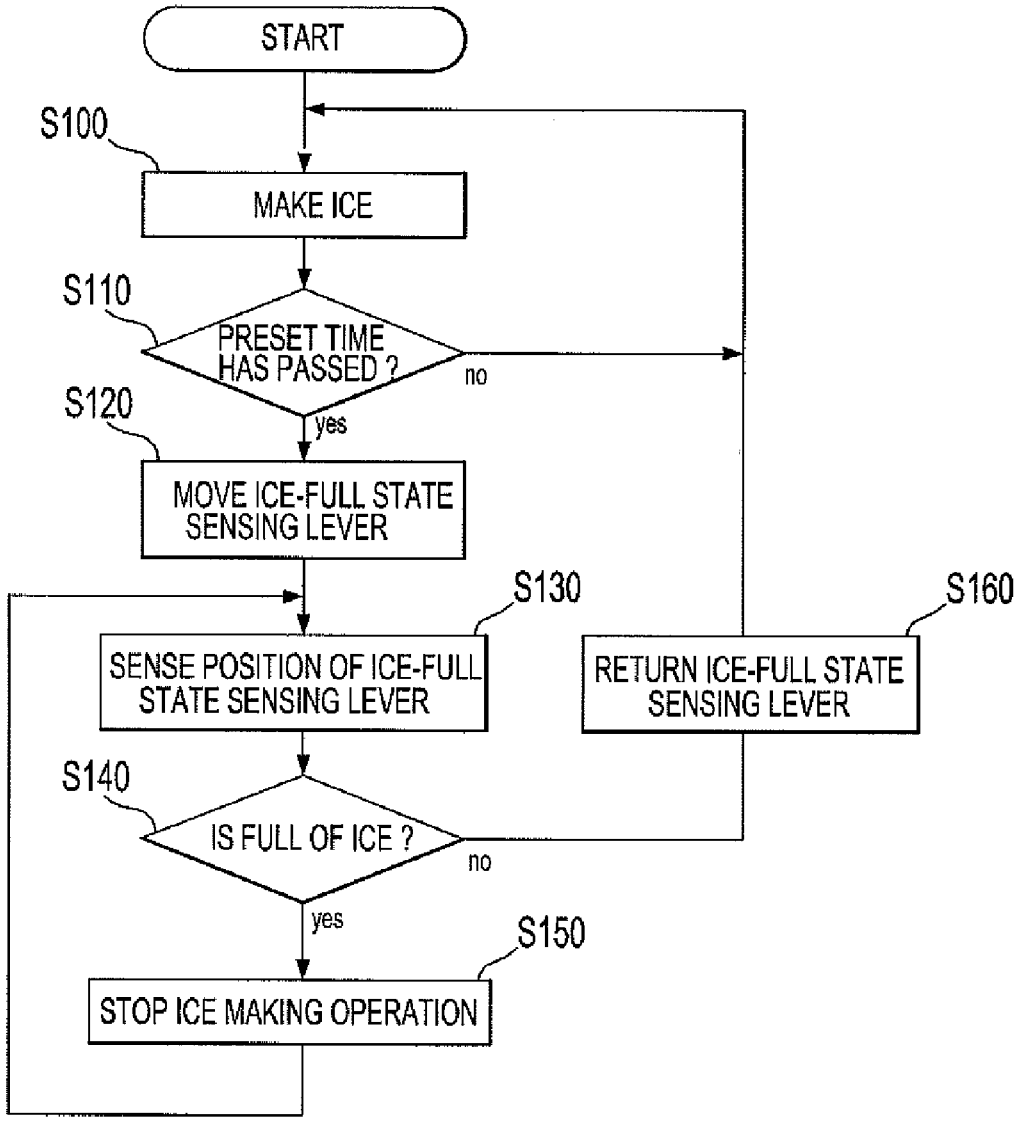
FIG. 6 is a flow chart showing a control method of the refrigerator according to the present invention.

Hereinafter, a control method of the refrigerator according to the present invention will be described in detail with reference to FIG. 6.

The control method of the refrigerator according to the present invention comprises an operation S100 to make ice by operation of the ice making device 40, operations S110, S120, S130, S140, and S160 to periodically move or return the ice-full state sensing lever 44 until it is determined that the ice reservoir 51 is full of ice, so as to determine whether or not the ice reservoir 51 is full of ice by use of the ice-full state sensing lever 44, and an operation S150 to stop the operation of the ice making device 40 when it is determined that the ice reservoir 51 is full of ice.

In the above described operations, the operations S110, S120, S130, S140, and S160, to determine whether or not the ice reservoir 51 is full of ice, comprise the operation S110 to determine whether or not a preset time has passed, the operation S120 to pivotally rotate the ice-full state sensing lever 44 after the preset time has passed such that a distal end of the ice-full state sensing lever 44 is moved downward, the operation S130 to sense the position of the ice-full state sensing lever 44 by use of the lever-position sensor 110, the operation S140 to determine whether or not the ice reservoir 51 is full of ice on the basis of the position of the ice-full state sensing lever 44 sensed by the lever-position sensor 110, and the operation S160 to return the ice-full state sensing lever 44 to an original position thereof if the ice reservoir 51 is not full of ice. The above operations S110 to S140 are repeatedly performed until it is determined that the ice reservoir 51 is full of ice.

After it is determined that the ice reservoir 51 is full of ice and the operation of the ice making device 40 is stopped, the operation 130 to sense the position of the ice-full state sensing lever 44 by use of the lever-position sensor 110 and the operation 140 to determine whether or not the ice reservoir 51 is full of ice on the basis of the position of the ice-full state sensing lever 44 sensed by the lever-position sensor 110 are performed. The operation S130 to sense the position of the ice-full state sensing lever 44 and the operation S140 to determine that the ice reservoir 51 is full of ice are repeatedly performed until it is determined that the ice reservoir 51 is not full of ice.

In conclusion, the ice-full state sensing lever 44 is repeatedly moved and returned until it is determined that the ice reservoir 51 is full of ice by operation of the ice making device 40. If it is determined that the ice reservoir 51 is full of ice, the operation of the ice making device 40 is stopped, and the ice-full state sensing lever 44 is kept in a moved state rather than being returned. Then, if the ice reservoir 51 becomes in a state which is not full of ice as the ice is discharged through the dispenser 30, the moved ice-full state sensing lever 44 determines that the ice reservoir 51 is not full of ice. Thereby, the ice-full state sensing lever 44 is returned to the original position thereof, and the ice making device 40 resumes the ice making operation.

As apparent from the above description, the present invention provides a refrigerator in which a lever cover is provided at one side of an ice making device to cover an ice-full state sensing lever. With the use of the lever cover, even if ice separated from an ice making tray is caught between the ice making device and a wall surface of an ice making compartment, the ice is caught between the lever cover and the wall surface of the ice making compartment. This has the effect of assuring a stable operation of the ice-full state sensing lever.

Although embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A refrigerator comprising an ice making device to make ice, and an ice reservoir disposed below the ice making device to receive the ice made by the ice making device, wherein:

the ice making device comprises an ice making tray, an ejector rotatably installed to separate the ice made in the ice making tray from the ice making tray, an ice-full state sensing lever installed, in a vertically pivotally rotatable manner, at one side of the ice making tray to sense whether or not the ice reservoir is full of ice, and a lever cover to cover a side surface of the ice-full state sensing lever, the lever cover is spaced apart from a side surface of the ice making tray by a predetermined distance, to install the ice-full state sensing lever between the lever cover and the side surface of the ice making tray, and the lever cover comprises a cover portion extending vertically to cover the side surface of the ice-full state sensing lever and a guide portion extending obliquely from an upper end of the cover portion to the top of a side region of the ice making tray so as to guide the ice separated from the ice making tray, the guide portion being integrally formed with the cover portion.

* * * * *